US011959716B2

(12) United States Patent
Balhan et al.

(10) Patent No.: US 11,959,716 B2
(45) Date of Patent: Apr. 16, 2024

(54) PISTOL WITH OPTIMIZED CHASSIS ANCHORING

(71) Applicant: FN HERSTAL S.A., Herstal (BE)

(72) Inventors: Laurent Balhan, Mormont (BE); Dorian Delvaux, Sambreville (BE); Denis Gridelet, Wonck (BE)

(73) Assignee: FN HERSTAL S.A., Herstal (BE)

( * ) Notice: Subject to any disclaimer, the term of this patent is extended or adjusted under 35 U.S.C. 154(b) by 210 days.

(21) Appl. No.: 17/763,550

(22) PCT Filed: Oct. 7, 2020

(86) PCT No.: PCT/EP2020/078045
§ 371 (c)(1),
(2) Date: Mar. 24, 2022

(87) PCT Pub. No.: WO2021/073962
PCT Pub. Date: Apr. 22, 2021

(65) Prior Publication Data

US 2022/0341687 A1 Oct. 27, 2022

(30) Foreign Application Priority Data

Oct. 14, 2019 (EP) ..... 19203129
Nov. 12, 2019 (EP) ..... 19208689

(51) Int. Cl.
*F41A 3/66* (2006.01)

(52) U.S. Cl.
CPC ..... *F41A 3/66* (2013.01)

(58) Field of Classification Search
CPC ..... F41A 3/66; F41A 3/26; F41A 3/14
See application file for complete search history.

(56) References Cited

U.S. PATENT DOCUMENTS 11,402,165 B1 * 8/2022 Besselink ..... F41A 3/86
2021/0325141 A1 * 10/2021 Mumford ..... F41A 3/66

FOREIGN PATENT DOCUMENTS

| | | | |
|---|---|---|---|
| EP | 0890072 | B1 | 3/1997 |
| EP | 0979986 | A2 | 2/2000 |
| EP | 1031811 | A2 | 2/2000 |
| WO | 2016127194 | A1 | 8/2016 |

OTHER PUBLICATIONS

International Search Report and Written Opinion of the International Searching Authority from the European Patent Office, in PCT/EP2020/078045 dated Dec. 9, 2020, which is an international application corresponding to this U.S. application.

* cited by examiner

*Primary Examiner* — J. Woodrow Eldred
(74) *Attorney, Agent, or Firm* — Kolitch Romano Dascenzo Gates LLC

(57) ABSTRACT

A pistol is disclosed, including a body made from synthetic material having a channel formed inside the body. A slide is guided in a longitudinal direction of the body, the slide including a barrel and a breech. A single-block chassis having an elongated shape extends from a central portion of the body to a rear end of the body. The chassis further includes guiding elements for guiding the slide. The pistol is configured such that the channel is designed to receive the chassis removably, and the chassis is fastened to the body using a formfitting, sliding connection.

15 Claims, 6 Drawing Sheets

PISTOL WITH OPTIMIZED CHASSIS ANCHORING

INTRODUCTION

Published patent document EP 0 890 072 B1 discloses a pistol with a plastic body in which slide guiderails are overmolded directly. This solution has the flaw that the alignment of the rails is not maintained due to deformations experienced by the body during firing cycles.

In order to address this, a monobloc metal chassis incorporating sliding rails was proposed in document EP 0 979 986 B2, thus ensuring better overall rigidity of the weapon and a controlled alignment between the front and rear slide guiderails. Relative to the overall mechanical strength of the weapon, the chassis becomes the element that takes up the main stresses during a firing cycle (e.g., unlocking force, rear stop force of the barrel, rear stop force of the slide).

The chassis connecting the slide guide rails, both front and rear, due to its monolithic structure, therefore returns the forces over its entire length as in document EP 0 979 986 B2, where the chassis is inserted rotatably with a bracket positioned at a rear end thereof. The main stresses obtained during unlocking, via the axis or the at least one ramp of the same name, tend to lift and cause significant flexion of the chassis, which transmits these strong mechanical stresses to the rear part of the chassis via the bracket. The amplitude of these mechanical stresses is sufficient to cause fatigue cracks in the chassis.

TECHNICAL FIELD

The present disclosure relates to the field of firearms, and more particularly to a pistol.

SUMMARY

The present disclosure aims to address at least one of the drawbacks of the aforementioned state of the art. More particularly, the present disclosure aims to improve the mechanical strength of the weapon.

The present disclosure relates to a pistol comprising:

- a body made from synthetic material having a channel formed inside the body, said body including a grip positioned below said channel;
- a slide guided in a longitudinal direction of the body, said slide comprising a breech and a barrel, the barrel comprising a first unlocking means including at least one ramp;
- a trigger mechanism;
- a chassis, preferably one-piece, having an elongated shape extending longitudinally from a central portion of said body to a rear end of the body, in particular ensuring the maintenance and/or the guiding of the movable elements of the trigger mechanism, said chassis further comprising guiding elements for guiding the slide and a second unlocking means, such as an unlocking pin, the first and second unlocking means being configured such that the first unlocking means bears, during use, on the second unlocking means in order to unlock the barrel;
- the pistol being such that the channel is designed to receive the chassis removably;
- remarkable in that the chassis is fastened to the body using a formfitting connection, sliding along a translation direction and an angle between said direction and a tangent to a point of impact on the at least one ramp that impacts the second unlocking means, in particular the unlocking pin at said point during the rearward movement of the at least one ramp, is inclusively between −5° and +5°, preferably between −2° and +2°.

According to one advantageous embodiment of the present disclosure, the mounting rail comprises one or several of the following technical features, according to any possible combination:

- the predefined translation direction is inclined relative to the longitudinal direction such that the formfitting connection causes a rearward and downward movement of the weapon;
- the predefined translation direction forms an angle inclusively between 30° and 60° relative to the longitudinal direction, preferably from 40° to 50°, preferably close to 45°;
- the formfitting connection is of the tongue-and-groove type;
- the chassis comprises two parallel branches delimiting a loading zone, each branch comprising a partition extending in a plane parallel to a median plane of the pistol;
- the formfitting connection comprises at least one pair of planar bearing surfaces formed on the chassis, each planar bearing surface bearing on an opposite bearing surface formed on the body;
- each planar bearing surface is positioned on a front end of the chassis, a front portion of the chassis, a central position of the chassis, a rear portion of the chassis, or a rear end of the chassis;
- the or each opposite planar bearing surface is positioned at the central portion of the body, a front portion of the body, or a rear portion of the body;
- the first unlocking means, the second unlocking means, and the at least one pair of planar bearing surfaces and/or the at least one pair of opposite planar bearing surfaces are configured such that the line of action of the unlocking force passes through the center of inertia of the at least one pair of bearing surfaces and/or the at least one pair of opposite bearing surfaces;
- the first unlocking means, the second unlocking means, and the at least one pair of planar bearing surfaces and/or the at least one pair of opposite planar bearing surfaces are configured such that the distance between the center of inertia of the second unlocking means, in particular an unlocking axis and the center of inertia of the at least one pair of bearing surfaces and/or the at least one pair of opposite bearing surfaces is less than 25% of the length of the chassis, preferably 10% of the length of the chassis (along the longitudinal direction);
- the center of inertia of the at least one pair of bearing surfaces and/or the at least one pair of opposite bearing surfaces is positioned behind or in front of the center of inertia of the second unlocking means, in particular the unlocking pin;
- the second unlocking means is not in direct contact with the body;
- each planar bearing surface is defined by a flank of a groove disposed on the chassis;
- each groove extends along the predefined translation direction, the flank of said groove being oriented toward the rear of the pistol;
- the channel has a bottom and each of the partitions bears against said bottom;
- each groove is formed on an outer side surface of the corresponding partition;

each opposite bearing surface is defined by a flank of a tongue disposed on the body;

each tongue is adapted to cooperate with the corresponding groove;

the functional clearance between said tongue and said groove in a direction perpendicular to the at least one pair of bearing surfaces and/or the at least one pair of opposite bearing surfaces is inclusively between 0 and 100 microns, and in particular between 0 and 50 microns, notably between 0 and 20 microns, in this case, a pin at the front of said channel preferably maintains the chassis in the body when the weapon is at rest;

the functional clearance between said tongue and said groove in a direction perpendicular to the at least one pair of bearing surfaces and/or at least one pair of opposed bearing surfaces is negative (ie there is a positive interference and the chassis is introduced by forcing and elastic deformation of the body) between 0 and −100 microns, in particular between 0 and −50 microns, in particular between 0 and −20 microns;

each tongue extends from the bottom of the channel to the corresponding upper edge of the channel;

each tongue is formed on a flank of the corresponding channel;

the loading zone is suitable for a double column of projectiles, said column extending up to the height of the partitions;

the chassis comprises a slide release pin rotatably mounted in the chassis and the slide release pin has no contact with the body, owing to the use of mistake-proofing means;

the release pin is rotatably mounted in the two partitions;

the release pin comprises the unlocking pin;

the release pin is mounted loosely in two openings respectively formed on walls bordering either side of the channel;

each of the openings is a notch formed on the corresponding upper edge of the channel.

The present disclosure can also relate to a pistol comprising: a body made from synthetic material having a channel formed inside the body, said body including a grip positioned below said channel; a slide guided in a longitudinal direction of the body, said slide comprising a barrel and a breech; a trigger mechanism; a preferably one-piece chassis having an elongated shape extending from a central portion of said body to a rear end of the body, in particular ensuring the maintenance and/or the guiding of the moving elements of the trigger mechanism, said chassis further comprising guide elements for guiding the slide, the pistol being such that the channel is designed to removably receive the chassis and the chassis comprises a slide release pin rotatably mounted in the chassis, wherein the slide release pin has no contact with the body.

Generally, the advantageous embodiments of each object of the present disclosure are also applicable to the other objects of the present disclosure. To the extent possible, each object of the present disclosure can be combined with the other objects. The objects of the present disclosure can also be combined with the embodiments of the disclosure, which can also be combined with one another.

The measures of the present disclosure are interesting in that they make it possible, with equal mechanical strength, to optimally limit stresses, and therefore to optimize the general geometry of the chassis. For example, the branches of the chassis that connect the front part to the rear part can be refined. The fine thickness of the branches of the chassis thus obtained allows a fairly fine space requirement widthwise around the magazine, sufficient to leave space for a magazine without staggered rows, that is to say operating on the principle of a double column up to the upper lips of the magazine. Additionally, the measures of the present disclosure allow a location and maintenance of the firing parts in a metal part offering fewer geometric dispersions relative to a plastic body and flexibility in the design of the body because the latter becomes only a gripping element that is much less functional than the prior art.

BRIEF DESCRIPTION OF THE DRAWINGS

Other features and advantages of the present disclosure will be better understood using the disclosure and the drawings.

LIST OF REFERENCES

Figure 1:
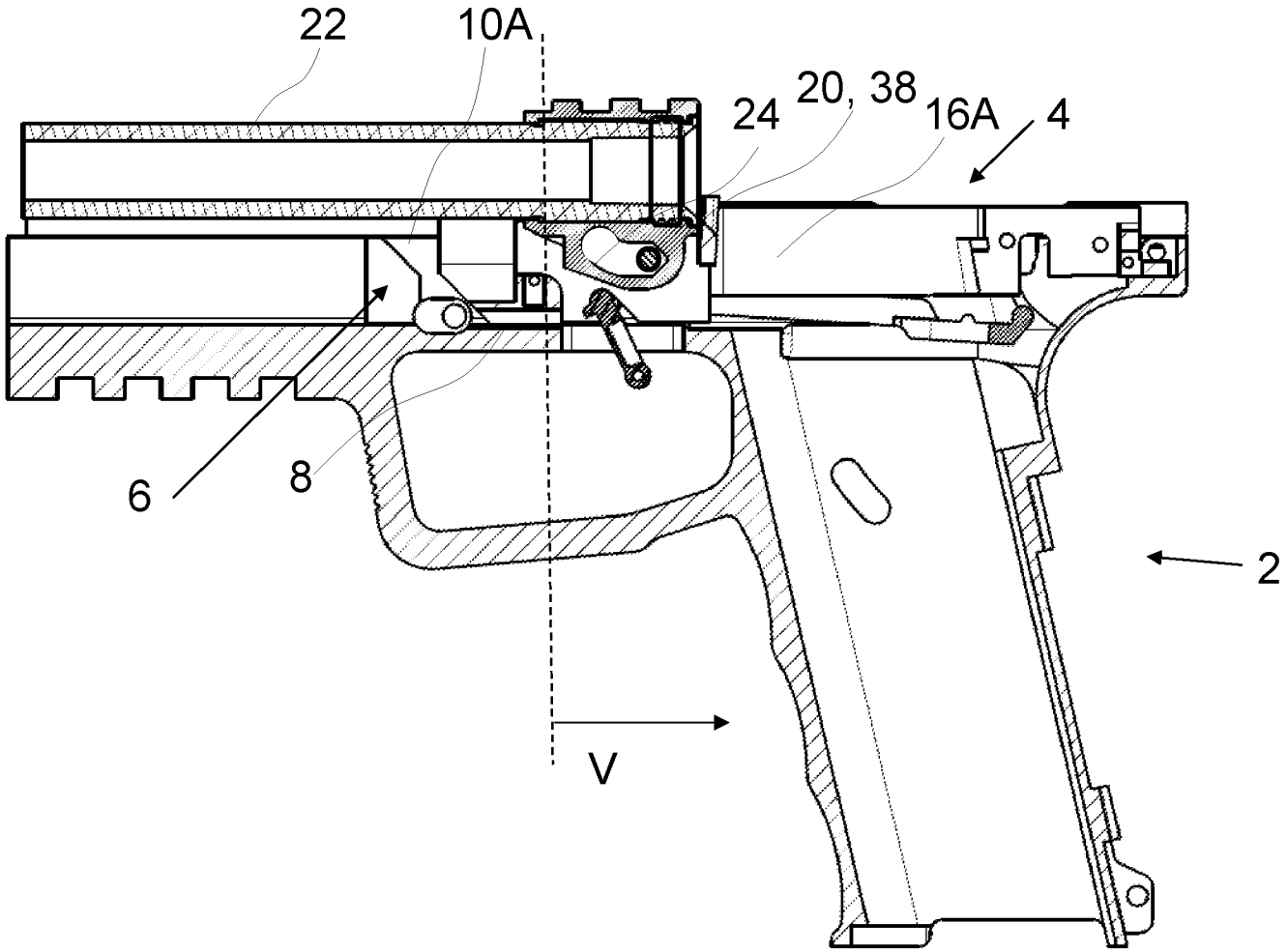
FIG. 1 shows a schematic sectional view in a median plane of a chassis mounted on a body of a pistol according to the present disclosure.

2 body
4 chassis
6 channel
8 bottom (of the channel)
10A, 10B flank (of the channel)
12A, 12B (planar) bearing surface
14A, 14B opposite bearing surface
16A, 16B branch, partition
20 unlocking pin
22 barrel
24 barrel unlocking ramp
32A, 32B groove
34A, 34B tongue
38 slide release pin
42 rear guide element for the slide
44 front guide element for the slide

DETAILED DESCRIPTION

FIG. 1 shows a schematic sectional view in a median plane (plane I) of a pistol body 2 and of a chassis 4 according to the present disclosure. The body 2 is made from synthetic material and has a channel 6 formed inside it. The body 2 comprises a grip positioned below the channel 6. The channel includes a bottom 8 delimited on either side by flanks 10A, 10B (see FIG. 5). The chassis 4 has an elongated shape extending from a central portion of the body 2 at a rear end of the body 2. The chassis 4 is preferably a single-block part. The chassis 4 can ensure the maintenance and/or the guiding of the moving elements of the trigger mechanism, said chassis 4 further comprising guide elements 42, 44 for guiding the rail. The chassis 4 can comprise two parallel branches 16A, 16B in the form of partitions 16A, 16B delimiting, inter alia, a loading zone. Lastly, the chassis comprises an unlocking pin 20 or another equivalent unlocking means (functionally, a bearing surface on which the unlocking ramp bears during slide recoil).

The chassis 4 is fastened to the body 2 using a connection of the sliding type. A formfitting connection with one element sliding relative to the other ("formschlüssig" in German) can comprise a dovetail connection, a tongue and groove connection, or a mortise-and-tenon connection. In FIG. 1, the formfitting connection is positioned in a front part of the chassis 4 (in front of the unlocking pin 20). Alternatively, the formfitting connection can be positioned behind the unlocking ramp 24 when the barrel 22 is locked. The "front" of the pistol is by definition positioned at the opening of the barrel 22. Preferably, the formfitting connection is positioned in front of the unlocking pin 20 so as to cause the metal chassis to work essentially in compression and not in traction/flexion as illustrated. Therefore, it is recommended to have the unlocking pin 20 as close as possible to the formfitting connection in order to reduce the section of the chassis (that is to say between the unlocking pin 20 and the formfitting connection) that is subject to a traction/flexion or compression/flexion force depending on the case.

Figure 2:
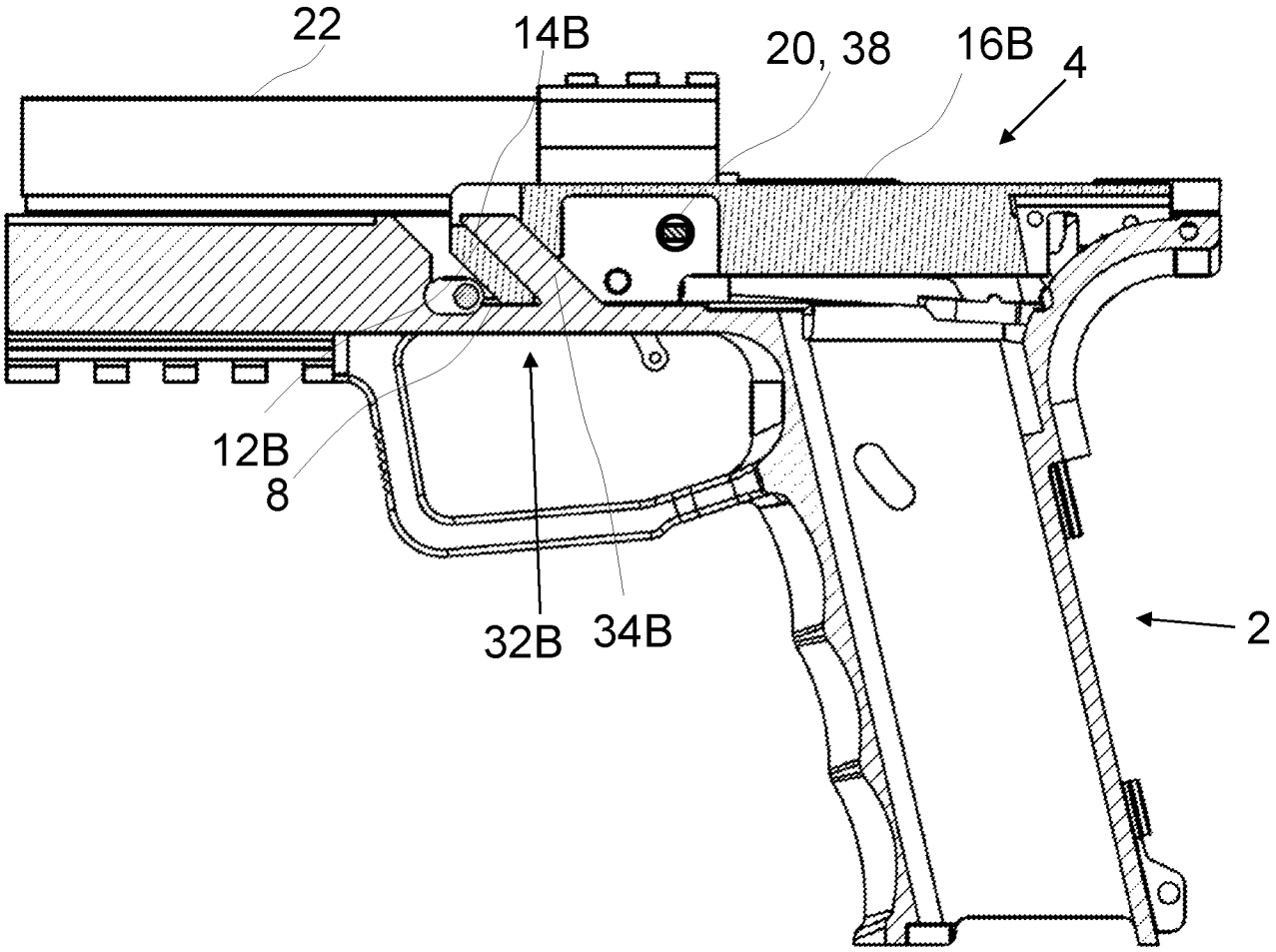
FIG. 2 illustrates a schematic sectional view in a cross-section parallel to the median plane of the chassis mounted on the body of the pistol according to the present disclosure.

FIG. 2 illustrates a schematic section in a cross-section parallel (plane II) to the median plane of the chassis 4 mounted on the body 2 of the pistol according to the present disclosure. The formfitting connection slides in translation, preferably only in translation. The female part of the formfitting connection preferably comprises two parallel grooves 32A, 32B respectively formed on outer lateral surfaces of the two partitions 16A, 16B of the chassis 4. The translation direction is preferably inclined relative to the longitudinal direction with an angle inclusively between 20° and 80°, preferably between 30° and 60°; with a slope increasing toward the front of the weapon. The optimal angle can be chosen such that the translation direction is substantially perpendicular to the direction of the unlocking force. Thus, the force resulting from the unlocking, which tends both to lift the chassis 4 and to push it toward the rear, is better distributed when the two planar bearing surfaces 12A, 12B are oriented toward the top and the rear of the pistol. Furthermore, the incline makes it possible to increase the contact surface and therefore to reduce the pressure exerted by the two planar bearing surfaces 12A, 12B during a firing cycle.

Figure 3:
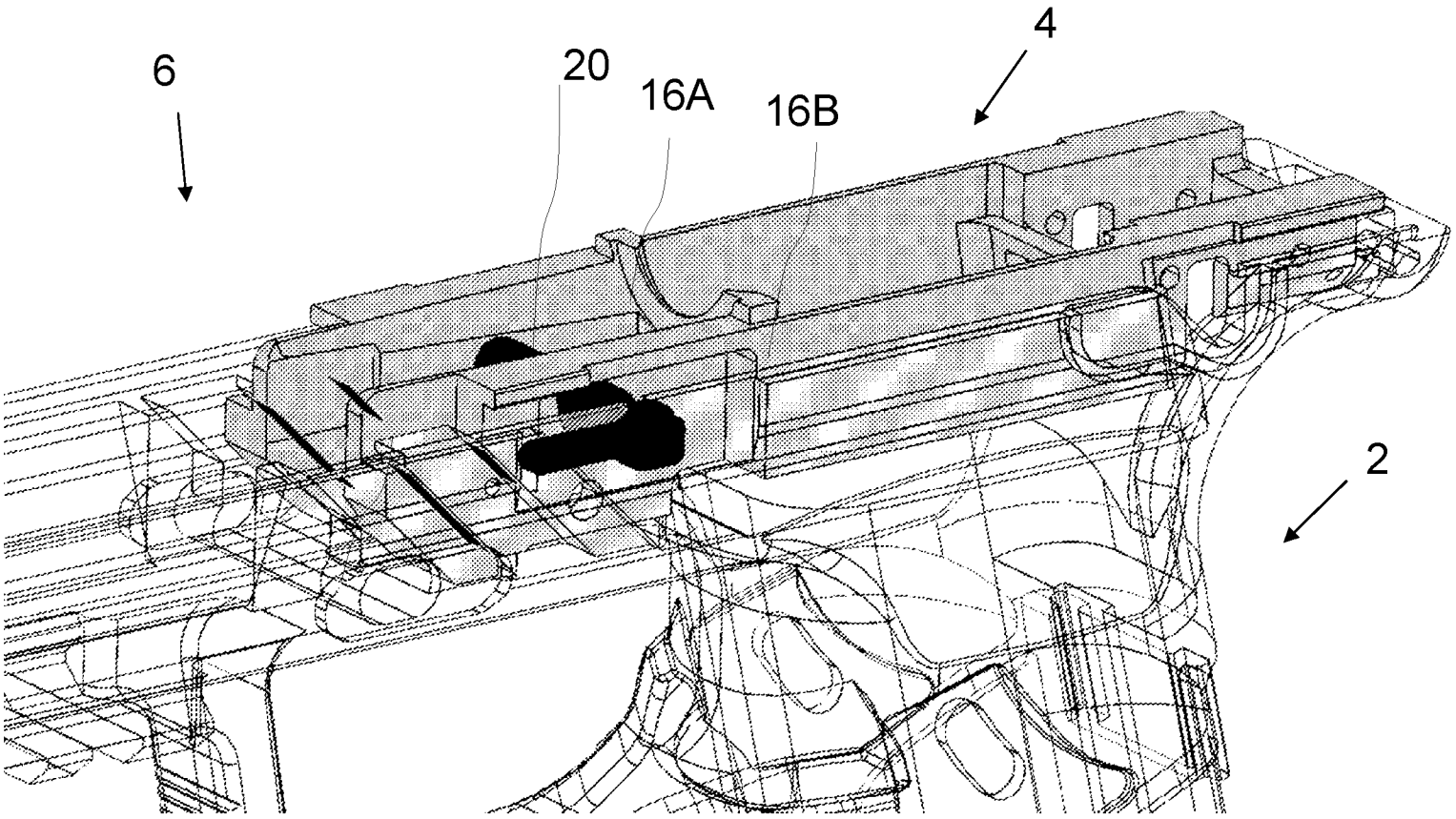
FIG. 3 shows a schematic perspective view of the chassis mounted on the body of the pistol according to the present disclosure.

FIG. 3 shows a schematic perspective view of the chassis mounted on the body of the pistol according to the present disclosure.

Figure 4A:
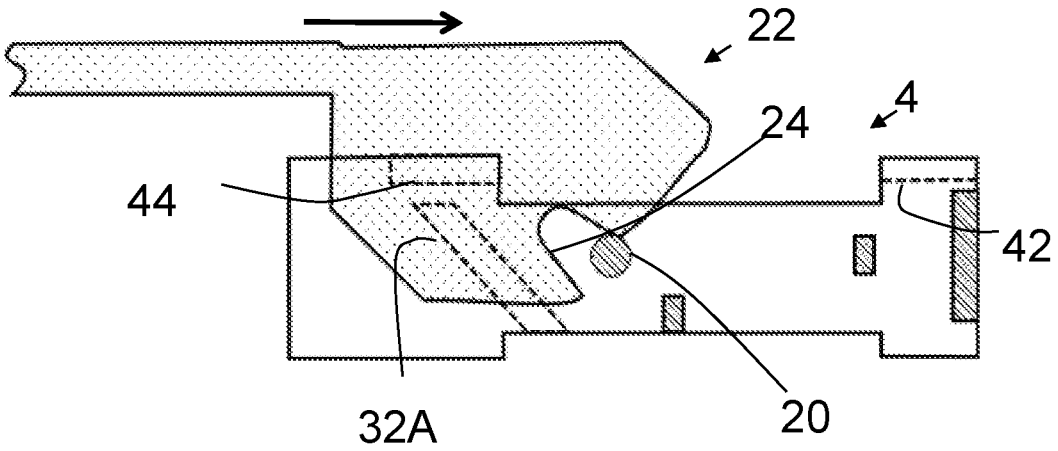
FIG. 4*a* shows the rear part of a barrel and the chassis according to the present disclosure at an instant before the contact between a locking pin secured to the chassis and the at least one unlocking ramp arranged on the barrel.
Figure 4B:
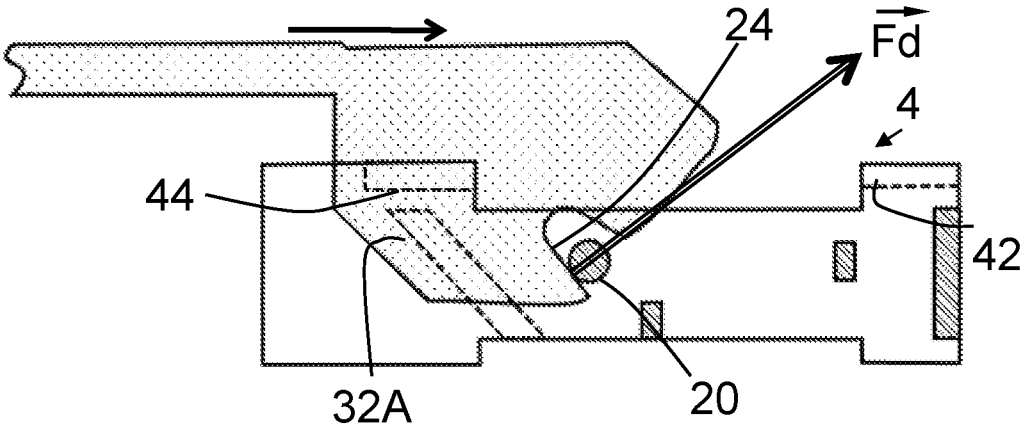
FIG. 4*b* illustrates the rear part of the barrel and the chassis according to the present disclosure at the moment where the unlocking pin is impacted by the at least one unlocking ramp of the barrel.
Figure 4C:
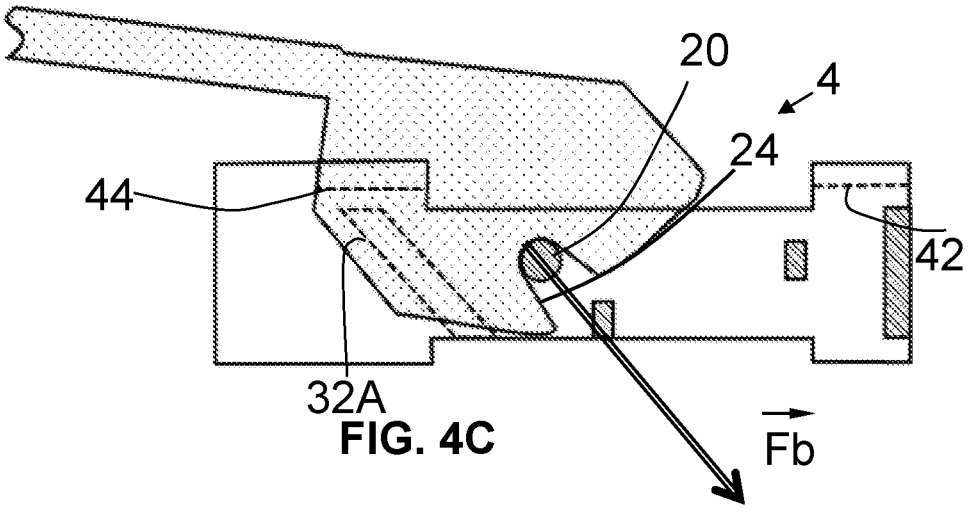
FIG. 4*c* shows the rear part of the barrel and the chassis according to the present disclosure at the instant where the unlocking pin is in abutment against the slot of the at least one unlocking ramp of the barrel.

FIGS. 4*a*, 4*b* and 4*c* illustrate three steps during the unlocking of the barrel 22: an instant before the contact between an unlocking pin 20 secured to the chassis 4 and at least one unlocking ramp 24 arranged on the barrel 22, the instant where the unlocking pin 20 is impacted by the unlocking ramp(s) 24 of the barrel 22, and the instant where the unlocking pin 20 is in abutment against the or each unlocking ramp slot 24 of the barrel 22.

FIG. 4*a* describes the rear part of the barrel 22 and the chassis 4 at an instant before the contact between the unlocking pin 20 secured to the chassis 4 and the or each unlocking ramp 24 arranged on the barrel 22. FIG. 4*a* shows a section of the chassis 4 in a vertical plane parallel to the median plane of the pistol. The median plane of the pistol is defined as a substantially symmetrical vertical plane passing through the center of inertia of the pistol. In this lateral view, the rear part of the barrel 22 has at least one ramp 24 that is suitable for bearing against a part of the chassis (unlocking pin 20) thus limiting the recoil of the barrel 22 after a shot. The ramp 24 shape and the positioning of the unlocking pin 20 are chosen to ensure tilting of the barrel. The tilting of the barrel 22 makes it possible to facilitate the supply of a cartridge after the lowering of the barrel 22 toward the lips of the magazine. In the described embodiment, an unlocking pin 20 is proposed. However, other means can be considered to cause the tilting of the barrel, for example lugs formed on the inner side walls facing the chassis 4. The unlocking pin 20, or the equivalent means and the chassis 4 can form a single (monobloc) part. According to the embodiments shown in FIGS. 1-3, 4*a*, 4*b*, 4*c*, 5 and 6, the release function and the unlocking function are performed by a same so-called unlocking and release pin. It is nevertheless obvious for one skilled in the art that these two functions can be performed by separate elements. This is in particular the case when the unlocking element and the chassis are formed in a single (monobloc) piece. FIG. 4*a* also illustrates rear 42 and front 44 guide elements for the barrel slide 22.

FIG. 4*b* shows the rear part of the barrel 22 and the chassis 4 at the moment where the unlocking pin 20 is impacted by the or each unlocking ramp 24 of the barrel 22. FIG. 4*b* illustrates the unlocking force by a vector "Fd". This force tends to lift the chassis 4. Preferably, the sliding direction of the formfitting connection is chosen so as to be substantially parallel (preferably + or −5 degrees) to a tangent of the or each unlocking ramp 24, the tangent passing through a point of the or each unlocking ramp 24 where the impact with the unlocking pin or the like takes place during a firing cycle (that is to say a portion of the or each unlocking ramp 24 that comes back into contact with the unlocking pin or the like during the unlocking process). More preferably, the sliding direction of the formfitting connection is chosen so as to be parallel to the tangent to the unlocking ramp(s) 24 at the point of impact (see FIG. 4*b*). The choice of an appropriate incline ensures a better transfer of the unlocking force. Still more advantageously, the pistol is designed such that the line of action (straight line that bears the force vector) of the unlocking force passes through the center of inertia of the (planar) bearing surfaces 12A, 12B and/or of the opposite (planar) bearing surfaces 14A, 14B (this embodiment is not shown). This configuration makes it possible to not transfer torque resulting from the unlocking force by the formfitting connection ensuring a homogenization of the resultant stresses. Additionally, the first unlocking means 24 can comprise two unlocking ramps 24 positioned on either side of the median plane of the pistol. The or each unlocking ramp 24 can be formed by a portion of an edge of an orifice (for example bean-shaped), a notch, or an arm formed behind the barrel 22.

FIG. 4*c* shows the rear part of the barrel 22 and the chassis 4 at the instant where the unlocking pin 20 abuts against the slot of the or each unlocking ramp 24 of the barrel 22. FIG. 4*c* illustrates the barrel abutment force (Vector Fb).

The male part of the formfitting connection preferably comprises two tongues 34A, 34B formed on two inner flanks 10A, 10B facing the channel 6 of the body 2. The two tongues 34A, 34B extend from the bottom 8 of the channel 6 to the upper edges facing the channel 6. The tongues 34A, 34B are preferably configured to engage in translation in grooves 32A, 32B formed on the chassis 4, the grooves 32A, 32B constituting the female part of the formfitting connection. The two tongues 34A, 34B positioned on the body 2 preferably have two so-called opposing surfaces 14A, 14B bearing against the planar surfaces 12A, 12B formed at least on the respective grooves 32A, 32B positioned on the chassis 4.

In FIGS. 1-3, 4*a*, 4*b*, 4*c*, 5 and 6, the female part of the formfitting connection is formed at the front end of the chassis 4 such that the forces related to the firing cycles (e.g., unlocking) are transmitted directly to the body via the formfitting connection by "bypassing" the central and rear part of the chassis 4. Thus, the central and rear part of the chassis 4 are to a certain extent exposed very little or even not exposed to the mechanical stresses resulting from the firing cycle. The body 2 can comprise, at the formfitting connection, overthicknesses at the lateral flanks of the channel 6 so as to reduce the stresses related to the transfers of the firing forces.

The partitions (branches) 16A, 16B are preferably connected at least at a front part of the chassis 4, to the front of the loading zone, by a release pin of the barrel (FIG. 2).

The pistol according to the present disclosure also comprises a barrel slide (not illustrated) guided in a longitudinal direction of the body 2. The barrel slide comprises: a barrel and a breech. The pistol also includes a trigger mechanism (not illustrated).

According to the embodiment shown in FIGS. 1-3, 4*a*, 4*b*, 4*c*, 5, and 6, the release pin 38 is combined with the unlocking pin 20. This release pin 38 is preferably mounted rotatably in the chassis 4. This release pin 38 passes through the two branches 16A, 16B of the body at two openings. The dimensions of the two openings are chosen such that the rotatable connection between the release pin 38 and the openings is loose, thus preventing part of the forces from being able to be transmitted directly by the release pin 38 to the body 2 and therefore making it possible to free the zone between the formfitting connection and the release pin 38. The release pin 38 comprises an outer actuating lever and an inner lever that is provided for the disassembly of the barrel and of the slide.

When the disassembly and unlocking functions are separate, the two pins (or other disassembly/unlocking means) preferably do not have direct contact with the body, so as to avoid any direct stress transfer.

Figure 5:
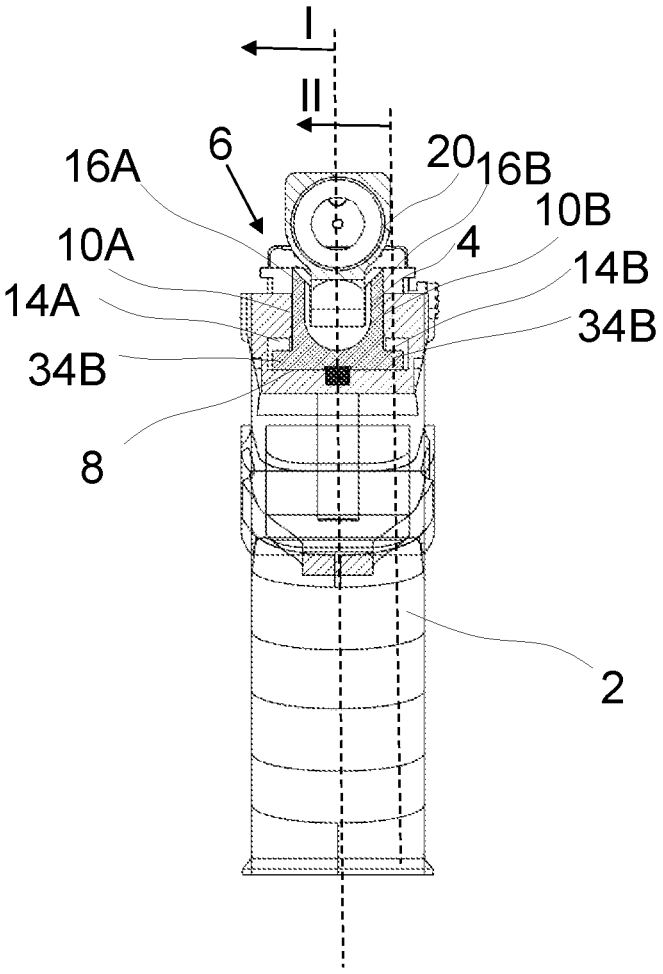
FIG. 5 illustrates a front cross-section of the chassis mounted on the body of the pistol according to the present disclosure.

FIG. 5 illustrates a front section (plane V) of the chassis 4 mounted on the body 2 of the pistol according to the present disclosure. In this view, the channel 6 of the body 2 preferably has a bottom 8 on which the chassis 4 rests.

In one preferred embodiment, portions of the partitions 16A, 16B of the chassis 4 in front of the respective grooves 32A, 32B extend to the bottom 8 and bear against the bottom 8 and form a second transfer interface for forces related to the firing cycles. More particularly, this interface takes up part of the vertical component of the forces related to the firing cycles (e.g., barrel rear abutment force).

Figure 6:
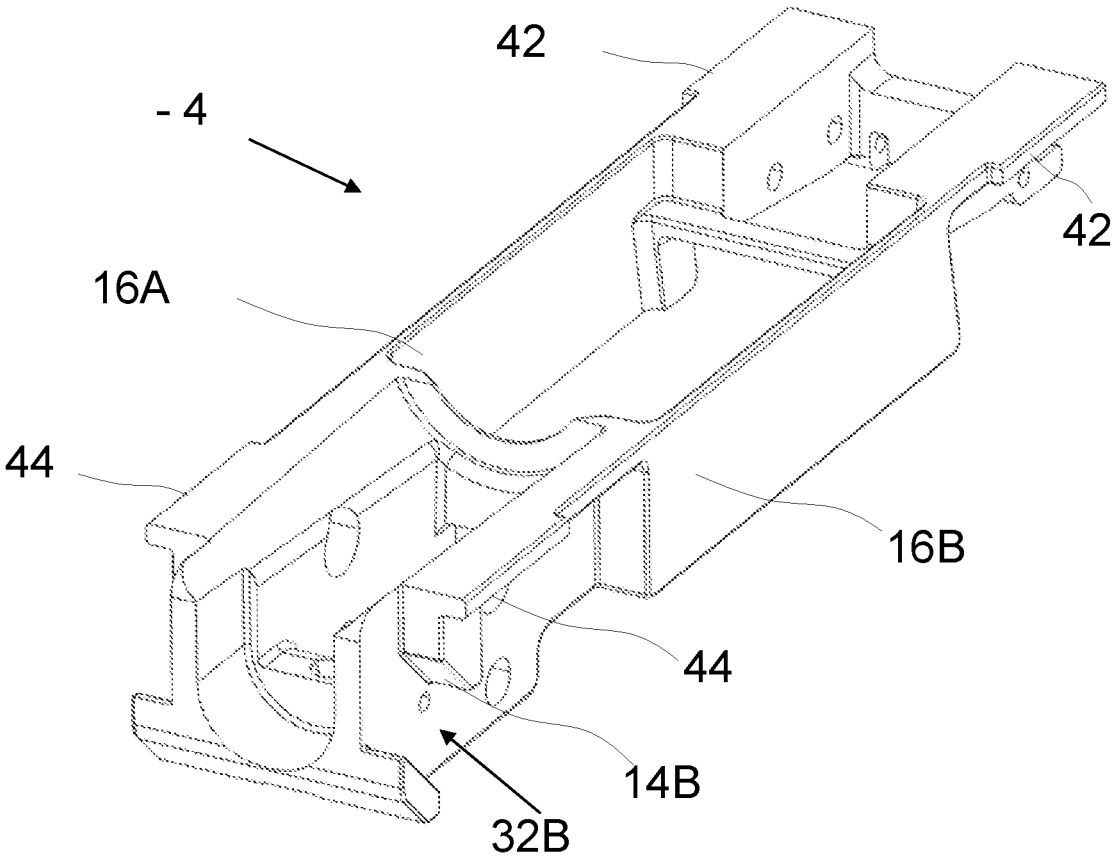
FIG. 6 shows a schematic perspective view of the chassis according to the present disclosure.

FIG. 6 shows a schematic perspective view of the chassis 4 according to the present disclosure. The loading zone formed between the two partitions 16A, 16B is suitable for a double column of projectiles.

According to the embodiment shown in FIGS. 1-3, 4*a*, 4*b*, 4*c*, 5, and 6, the formfitting connection comprises a pair of tongues and grooves. In an alternative that is not shown, the formfitting connection can comprise at least two pairs of tongues and grooves.

According to the embodiment shown in FIGS. 1-3, 4*a*, 4*b*, 4*c*, 5, and 6, the formfitting connection comprises a male part formed on the body 2 and a female part formed on the chassis 4. In another alternative that is not shown, the male part can be formed on the chassis 4 and a female part formed on the body 2. This alternative nevertheless has the drawback of having less material at the body 2 in order to distribute the forces transmitted by the chassis 4.

The invention claimed is:

1. A pistol comprising:

a body (2) made from synthetic material having a channel (6) formed inside the body (2), said body (2) including a grip positioned below said channel (6);

a barrel slide guided in a longitudinal direction of the body (2), said slide comprising a barrel (22) and a breech, the barrel (22) comprising a first unlocking means (24), including at least one ramp (24);

a trigger mechanism;

a one-piece chassis (4) having an elongated shape extending longitudinally from a central portion of said body (2) to a rear end of the body (2), ensuring maintenance and/or guiding of moving elements of the trigger mechanism, said chassis (4) further comprising guiding elements for guiding the slide and a second unlocking means (20) comprising an unlocking pin (20), the first (24) and second (20) unlocking means being configured such that the first unlocking means (24) bears, during use, on the second unlocking means (20) to unlock the barrel (22);

the pistol being such that the channel (6) is designed to removably receive the chassis (4);

characterized in that the chassis (4) is fastened to the body (2) using a formfitting connection, sliding along a predefined translation direction and an angle between said direction and a tangent to a point of impact on the at least one ramp (24) that impacts the unlocking pin (20) of the second unlocking means (20) at said point during movement toward the rear of the at least one ramp (24), is inclusively between −5° and +5°.

2. The pistol according to claim 1, characterized in that the predefined translation direction is inclined relative to the longitudinal direction such that the formfitting connection causes a rearward and downward movement of the chassis (4) of the pistol.

3. The pistol according to claim 1, characterized in that the predefined translation direction forms an angle inclusively between 30° and 60° relative to the longitudinal direction.

4. The pistol according to claim 1, characterized in that the formfitting connection is of a tongue-and-groove type.

5. The pistol according to claim 1, characterized in that the chassis (4) comprises two parallel branches (16A, 16B) delimiting inter alia a loading zone, each branch (16A, 16B) comprising a partition (16A, 16B) extending in a plane parallel to a median plane of the pistol.

6. The pistol according to claim 1, characterized in that the formfitting connection comprises at least one pair of planar bearing surfaces (12A, 12B) formed on the chassis (4), each planar bearing surface (12A, 12B) bearing on an opposite bearing surface (14A, 14B) formed on the body (2).

7. The pistol according claim 6, characterized in that the first unlocking means (24), the second unlocking means (20), and the at least one pair of planar bearing surfaces (12A, 12B) and/or the at least one pair of opposite planar bearing surfaces (14A, 14B) are configured such that a line of action of the unlocking force passes through the center of inertia of the at least one pair of bearing surfaces (12A, 12B) and/or the at least one pair of opposite bearing surfaces (14A, 14B) and/or the first unlocking means (24), the second unlocking means (20), and the at least one pair of planar bearing surfaces (12A, 12B) and/or the at least one pair of opposite planar bearing surfaces (14A, 14B) are configured such that a distance between the center of inertia of the second unlocking means (20), in particular the unlocking pin (20) and the center of inertia of the at least one pair of bearing surfaces (12A, 12B) and/or the at least one pair of opposite bearing surfaces (14A, 14B) is less than 25% of a length of the chassis.

8. The pistol according to claim 6, characterized in that each planar bearing surface (12A, 12B) is defined by a flank of a corresponding groove (32A, 32B) positioned on the chassis (4).

9. The pistol according claim 8, characterized in that each groove (32A, 32B) extends along the predefined translation direction, the flank of said groove (32A, 32B) being oriented toward the rear of the pistol.

10. The pistol according to claim 5, characterized in that the channel (6) has a bottom (8) and each of the partitions (16A, 16B) bears against said bottom (8).

11. The pistol according to claim 5, characterized in that each groove (32A, 32B) is formed on an outer side surface of the corresponding partition (16A, 16B).

12. The pistol according to claim 6, characterized in that each opposite bearing surface (14A, 14B) is defined by a flank of a tongue (34A, 34B) positioned on the body (2).

13. The pistol according to claim 12, characterized in that each tongue (34A, 34B) is adapted to cooperate with the corresponding grooves (32A, 32B), a functional clearance between said tongue (34A, 34B) and said groove in a direction perpendicular to the at least one pair of bearing surfaces (12A, 12B) and/or the at least one pair of opposite bearing surfaces (14A, 14B) being inclusively between 0 and 100 microns.

14. The pistol according to claim 13, characterized in that each tongue (34A, 34B) extends from a bottom (8) of the channel (6) to the corresponding upper edge of the channel (6) and/or each tongue (34A, 34B) is formed on a flank (10A, 10B) of the corresponding channel (6).

15. The pistol according to claim 5, characterized in that the loading zone is adapted for a double column of projectiles, said column extending up to a height of the partitions (16A, 16B).

* * * * *